US009486675B1

(12) United States Patent
White

(10) Patent No.: US 9,486,675 B1
(45) Date of Patent: Nov. 8, 2016

(54) APPARATUS AND METHOD FOR MANUFACTURING SPORT BALLS

(71) Applicant: NIKE, Inc., Beaverton, OR (US)

(72) Inventor: Vincent F. White, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 230 days.

(21) Appl. No.: 14/169,900

(22) Filed: Jan. 31, 2014

(51) Int. Cl.
*A63B 45/00* (2006.01)

(52) U.S. Cl.
CPC ..... *A63B 45/00* (2013.01)

(58) Field of Classification Search
CPC ..... A63B 45/00
See application file for complete search history.

(56) References Cited

U.S. PATENT DOCUMENTS 3,617,589 A * 11/1971 Jones-Hinton ..... B29C 51/10 264/153
4,451,721 A * 5/1984 Nemeskeri ..... B29C 37/04 156/274.4
2009/0325745 A1 12/2009 Rapaport et al.
2010/0240479 A1 9/2010 Raynak et al.

* cited by examiner

*Primary Examiner* — Daniel McNally
(74) *Attorney, Agent, or Firm* — Quinn Law Group, PLLC

(57) ABSTRACT

An apparatus for manufacturing a sport ball may include a first component having a first baseplate and a plurality of support structures extending from the first baseplate and a second component having a second baseplate and a plurality of welding dies extending from the second baseplate. The apparatus may be configured such that, when the first component is assembled with the second component, each of the plurality of welding dies extending from the second baseplate of the second component aligns with one of the support structures extending from the first baseplate of the first component. In addition, the apparatus may be further configured to compress edges of casing panels against one another between the welding dies and the support structures. Further, the second component may be configured to supply welding energy to edges of casing panels when the casing panels are compressed between the welding dies and the support structures.

10 Claims, 21 Drawing Sheets

APPARATUS AND METHOD FOR MANUFACTURING SPORT BALLS

FIELD OF THE INVENTION

The present invention relates generally to an apparatus for manufacturing a sport ball and, more particularly, to an apparatus configured to perform welding of sport ball casing panels.

BACKGROUND

A variety of inflatable sport balls, such as a soccer ball, conventionally exhibit a layered structure that includes a casing, an intermediate layer, and a bladder. The casing forms an exterior portion of the sport ball and is generally formed from a plurality of durable and wear-resistant panels joined together along abutting edges. The intermediate layer forms a middle portion of the sport ball and is positioned between the casing and the bladder. Among other purposes, the intermediate layer may provide a softened feel to the sport ball, impart energy return, and restrict expansion of the bladder. The bladder, which has an inflatable configuration, is located within the intermediate layer to provide an interior portion of the sport ball. In order to facilitate inflation (i.e., with pressurized air), the bladder may include a valved opening that extends through each of the intermediate layer and casing, thereby being accessible from an exterior of the sport ball.

Ball manufacturing techniques have been developed that utilize welding to join casing panels. Welding alleviates the need to utilize adhesives or stitching to join panels. Consequently, weight can be saved by welding the ball, and other components may be added to increase performance, such as cushioning layers, restriction structures, or reinforcing layers. In addition, welding may be performed more quickly than stitching and with less expense. It would be desirable to further hasten the manufacturing process.

SUMMARY

The disclosed apparatus may be configured to perform multiple welds simultaneously, thereby reducing the time and expense of forming the casing and manufacturing the ball overall. The disclosed apparatus may be utilized by performing alternating, repetitive motions to reposition a sport ball casing for multiple welding steps, wherein each welding step simultaneously welds multiple seams of the casing.

In one aspect, the present disclosure is directed to an apparatus for manufacturing a sport ball. The apparatus may include a first component having a first baseplate and a plurality of support structures extending from the first baseplate and a second component having a second baseplate and a plurality of welding dies extending from the second baseplate. The apparatus may be configured such that, when the first component is assembled with the second component, each of the plurality of welding dies extending from the second baseplate of the second component aligns with one of the support structures extending from the first baseplate of the first component. In addition, the apparatus may be further configured to compress edges of casing panels against one another between the welding dies and the support structures. Further, the second component may be configured to supply welding energy to edges of casing panels when the casing panels are compressed between the welding dies and the support structures.

In another aspect, the present disclosure is directed to an apparatus for manufacturing a sport ball. The apparatus may include a first component having a first baseplate and a plurality of support structures extending from the first baseplate and a second component having a second baseplate and a plurality of welding dies extending from the second baseplate, the second component being configured to be assembled with the first component such that the plurality of welding dies align with the plurality of support structures. The apparatus may be configured to receive, between the first component and the second component, a preassembled sport ball casing formed of a plurality of panels temporarily held together in an inside-out configuration with adjoining edges of the panels extending radially outward forming flange portions. In addition, the apparatus may be configured to weld the adjoining edges of the panels together by applying pressure to the flange portions and supplying welding energy to the flange portions to form welded seams.

In another aspect, the present disclosure is directed to a method of manufacturing a sport ball. The method may include preassembling a sport ball casing by temporarily joining a plurality of casing panels together in an inside-out configuration, with adjoining edges of the panels extending radially outward from a center of the ball casing forming flange portions and supporting two or more of the flange portions on support structures of a first component of an apparatus. In addition, the method may include welding two or more seams between adjoining panels by compressing the two or more flange portions on the support structures by assembling a second component of the apparatus with the first component and applying pressure against the flange portions and the support structures with welding dies that align with the support structures when the first component is assembled with the second component, and supplying welding energy to the flange portions to joining the adjoining panels together forming welded seams.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The drawings are schematic and, therefore, the components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
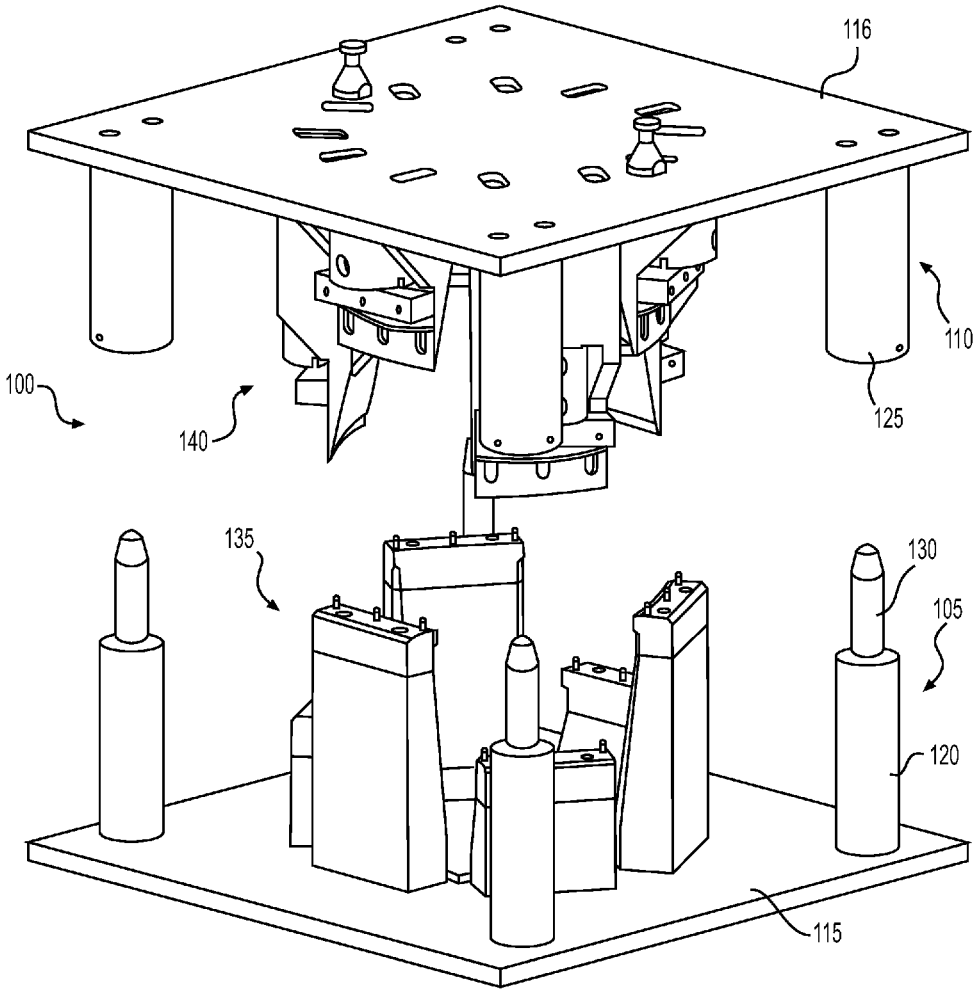
FIG. 1 is a schematic illustration of an exploded view of an exemplary apparatus for welding seams between panels of a sport ball casing.

The following discussion and accompanying figures disclose various sport ball configurations and methods relating to manufacturing of the sport balls. Although the sport ball is discussed and depicted in relation to a soccer ball, concepts associated with the disclosed configurations and methods may be applied to various types of sport balls. In addition to soccer balls, therefore, concepts discussed herein may be incorporated into basketballs, footballs (for either American football or rugby), volleyballs, and water polo balls, for example. A variety of non-inflatable sport balls, such as baseballs and softballs, may also incorporate concepts discussed herein. Accordingly, the concepts disclosed herein may apply to a wide variety of sport balls.

The term "horizontal," as used throughout this detailed description and in the claims, refers to any direction substantially parallel with the ground. Similarly, the term "side," as used in this specification and in the claims, refers to any portion of a component facing generally in a horizontal direction, as opposed to an upward or downward direction.

The term "vertical," as used throughout this detailed description and in the claims, refers to a direction generally perpendicular to horizontal directions. For example, in cases where an apparatus is planted flat on a ground surface, the vertical direction may extend from the ground surface upward. It will be understood that each of these directional adjectives may be applied to individual components of an assembly. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof is defined as the bond, link, or structure that joins two elements through a process that involves a softening or melting of a polymer material within at least one of the elements such that the materials of the elements are secured to each other when cooled.

As examples, welding may involve (a) the melting or softening of two panels that include polymer materials such that the polymer materials from each panel intermingle with each other (e.g., diffuse across a boundary layer between the polymer materials) and are secured together when cooled and (b) the melting or softening a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Welding may occur when only one panel includes a polymer material or when both panels include polymer materials. Welding generally produces a heat affected zone in which the materials of the two joined components are intermingled. For purposes of this disclosure, this heat affected zone shall be considered a "weld" or "thermal bond."

Additionally, welding does not generally involve the use of stitching or adhesives, but involves directly bonding components to each other with heat. In some situations, however, stitching or adhesives may be utilized to supplement the joining of components through welding.

In some embodiments, sport ball casings may be formed of a plurality of panels. The panels may be joined to each other using welding to form the seams between the casing panels. As with traditional stitching of sport ball panels, the peripheral edges of the panels may be folded to form flange portions. The flange portions of adjacent panels may be welded to one another in a similar position as panels of a sewn ball casing. The majority of the seams may be formed by welding the panels to one another, forming the casing inside out. Once the majority of the seams are welded, the casing may be turned right side out through an opening between two or more panels that are not joined together. After the casing has been turned right side out, additional components may be inserted into the casing. For example a bladder configured to retain a pressurized gas may be inserted into the casing. In addition, an intermediate layer having a limited degree of stretch may be inserted between the bladder and the casing. General procedures for manufacturing a sport ball with welded seams may be performed as disclosed in Raynak et al., U.S. Patent Application Publication No. 2010/0240479, published on Sep. 23, 2010, and entitled "Sport Ball Casing and Methods of Making the Casing," the entire disclosure of which is incorporated herein by reference.

One advantage of utilizing a welding process to form the seams relates to the overall mass of the ball. Whereas approximately ten to fifteen percent of the mass of a conventional sport ball may be from the seams between panels, welding casing panels to one another to form the seams may reduce the mass by eliminating stitching and/or adhesives from the seam. The mass that would otherwise be imparted by the stitching and/or adhesives may be utilized for other structural elements that enhance the performance properties (e.g., energy return, sphericity, mass distribution, durability, aerodynamics) of the ball. Another advantage relates to manufacturing efficiency. Stitching each of the seams of a conventional sport ball may be a relatively time-consuming process, particularly when hand stitching is utilized. By welding panels together to form the seams between panels, the time necessary for forming casing may be reduced, thereby increasing the overall manufacturing efficiency.

In some embodiments, sport ball casing panels may include a polymer material that may be utilized to secure the panels to each other. Examples of suitable polymer materials for the casing may include thermoplastic and/or thermoset polyurethane, polyamide, polyester, polypropylene, and polyolefin. In some configurations, the casing may incorporate filaments or fibers that reinforce or strengthen the casing. In further configurations, casing 20 may have a layered structure that includes an outer layer of the polymer material and an inner layer formed from a textile, polymer foam, or other material that is bonded with the polymer material.

When exposed to sufficient heat, the polymer materials within the casing panels transition from a solid state to either a softened state or a liquid state, particularly when a thermoplastic polymer material is utilized. When sufficiently cooled, the polymer materials then transition back from the softened state or the liquid state to the solid state. Based upon these properties of polymer materials, welding processes may be utilized to form a weld that joins peripheral portions of panels to each other.

In some embodiments, an apparatus may be provided that is configured to weld multiple seams between casing panels of the same sport ball casing simultaneously. For example, in some embodiments, the apparatus may be configured to weld five seams of a thirty-seam sport ball casing simultaneously. Such a thirty-seam ball casing may include, for example, twelve pentagonal panels. In some embodiments, the apparatus is configured to weld all thirty seams of the thirty-seam sport ball by repositioning the casing within the apparatus five times.

Such a multi-seam welding apparatus may expedite manufacturing, because multiple seams may be welded simultaneously. In addition, this may reduce manufacturing costs as well. Further, such an apparatus may provide repeatability with respect to the characteristics of seam welds.

FIG. 1 shows an apparatus 100 for manufacturing a sport ball. Apparatus 100 may be configured to weld seams of a sport ball casing. As shown in FIG. 1, apparatus 100 may include a first component 105 and a second component 110. First component 105 and second component 110 may be configured to receive a pre-assembled sport ball casing having temporarily joined casing panels. First component 105 may be assembled with second component 110 to weld seams of the pre-assembled sport ball casing disposed within apparatus 100.

In some embodiments, first component 105 may be a lower component, as shown in FIG. 1. Apparatus 100 may further include a second component 110. In some embodiments, second component 110 may be an upper component, as shown in FIG. 1. It will be understood that, in some embodiments, such components may be reversed. It will also be understood that, in other embodiments, such components may be oriented sideways such that the two components are positioned horizontally opposed to one another, rather than vertically opposed, as shown in FIG. 1. Further, these components may be positioned and operated in any suitable orientation.

As shown in FIG. 1, first component 105 may have a first baseplate 115 and a plurality of support structures 135 extending from first baseplate 115. Second component 110 may have a second baseplate 116 and a plurality of welding dies 140 extending from second baseplate 116. As shown in FIG. 1, second component 110 may be configured to be assembled with first component 105 such that the plurality of welding dies 140 align with the plurality of support structures 135. For example, apparatus 100 may be configured such that, when first component 105 is assembled with second component 110, each of welding dies 140 aligns with one of support structures 135.

In some embodiments, apparatus 100 may include alignment structures, such as lower columns 120 and upper cylinders 125. As shown in FIG. 1, lower columns 120 may include upper attachment structures 130 configured to be received within upper cylinders 125 in order to align second component 110 with respect to first component 105.

In some embodiments, components of apparatus 100 may be modular. For example, in some embodiments, support structures 135 may be removable from first baseplate 115. Similarly, in some embodiments, welding dies 140 may be removable from second baseplate 116. This may facilitate replacement of such components. In addition, differently sized components may be mounted on the apparatus to accommodate differently sized casing panels. In addition, these components may be adjustable in one or more aspects. For example, support structures 135 may be positionable within a predetermined range of positions. In some embodiments, first baseplate 115 and second baseplate 116 may include multiple holes and/or slots for receiving fasteners configured to respectively attach support structures 135 and welding dies 140.

Figure 2:
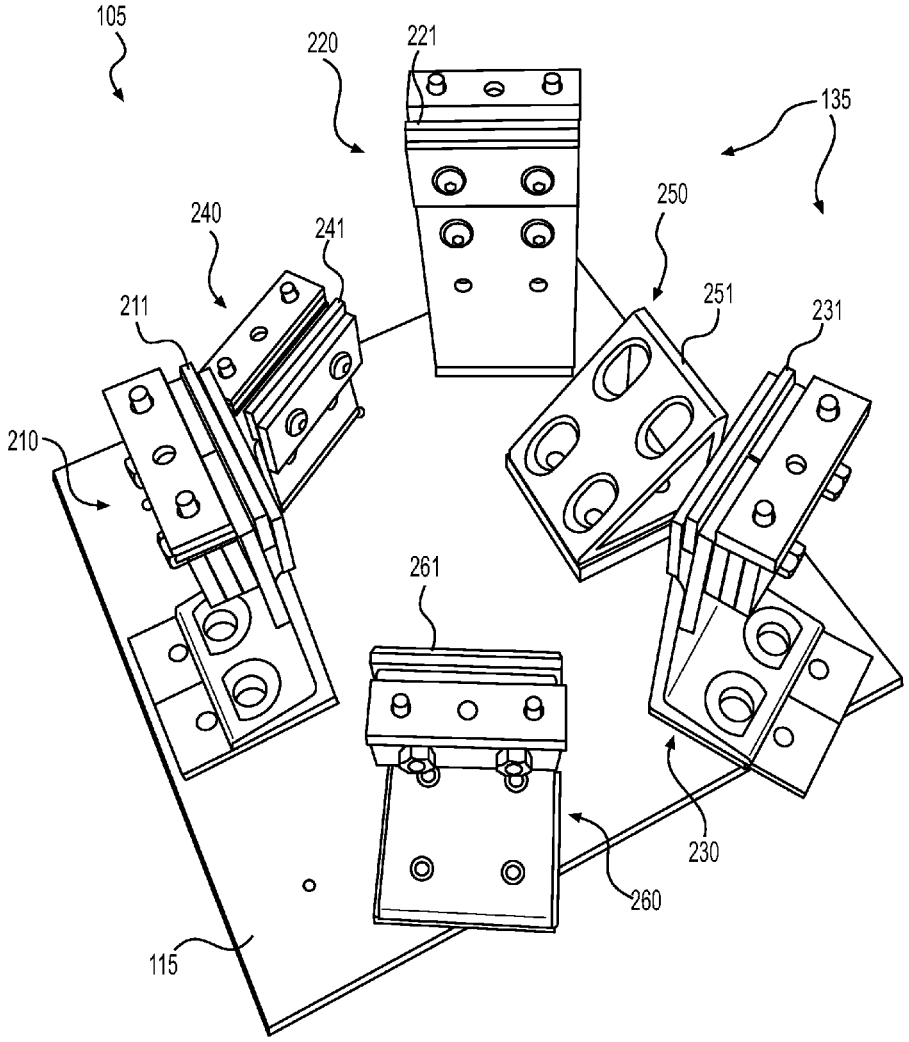
FIG. 2 is a schematic illustration of a lower component of the apparatus shown in FIG. 1.

FIG. 2 is a perspective top view of first component 105. For purposes of illustration, baseplate 115 is not shown in its entirety in FIG. 2. As shown in FIG. 2, support structures 135 may include a plurality of column-like or tower-like structures. In some embodiments, support structures 135 may have varying heights. For example, support structures 135 may include one or more taller support structures, such as a first support structure 210, a second support structure 220, and a third support structure 230. In addition, support structures 135 may include several relatively shorter support structures, such as a fourth support structure 240, a fifth support structure 250, and a sixth support structure 260.

Each of support structures 135 may include an edge upon which flanges of adjoining panels may be supported and welded. For example, first support structure 210 may include a first support edge 211. In some embodiments, first support edge 211 may be fixed with respect to first support structure 210 and/or baseplate 115. In other embodiments, first support edge 211 may be adjustable. For example, in some cases, first support edge 211 may be adjusted up and down to accommodate ball casings of different thicknesses.

Similarly, second support structure 220 may include a second support edge 221, third support structure 230 may include a third support edge 231, fourth support structure 240 may include a fourth support edge 241, fifth support structure 250 may include a fifth support edge 251, and sixth support structure 260 may include a sixth support edge. These support edges may have configurations similar to first support edge 211 discussed above. In some embodiments, one or more of the support structures may be used to support a portion of the casing, but not for welding. Accordingly, in some embodiments, fifth support structure 250 and fifth support edge 251 may be configured differently than the other support structures and edges, as shown in FIG. 2.

Figure 3:
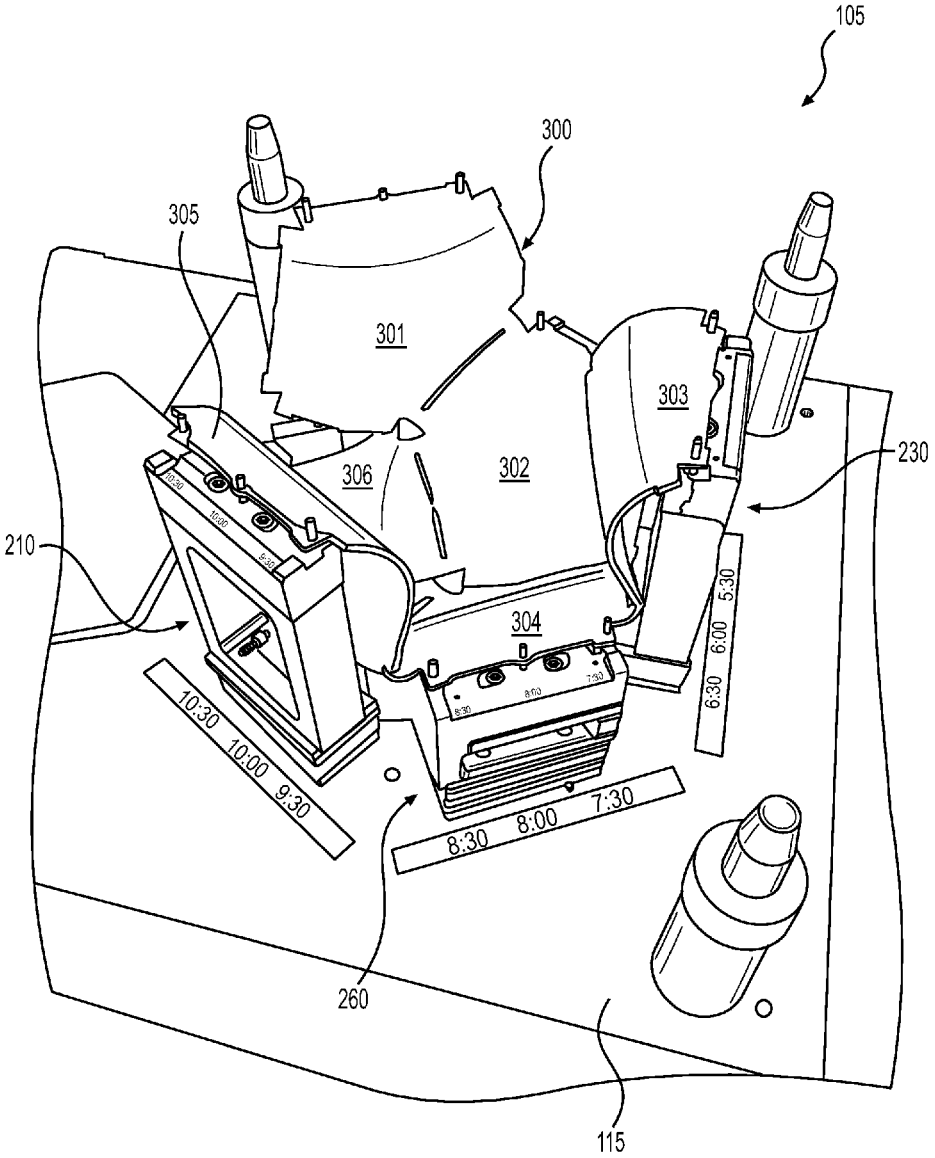
FIG. 3 is a schematic illustration of bottom panels of a sport ball casing being placed in the lower component shown in FIG. 2.

FIG. 3 is a perspective top view of first component 105 with panels of a sport ball casing 300 being assembled in place within first component 105. For example, as shown in FIG. 2, illustrates a first panel 301, a second panel 302, a third panel 303, a fourth panel 304, a fifth panel 305, and sixth panel 306. These six panels, when assembled may form a substantial hemisphere (for example the bottom half in the illustrated orientation) of casing 300, which may be joined to a second hemisphere. In some embodiments, these panels may be substantially pentagonal, as shown in FIG. 3. In particular, each of the panels may have a substantially regular (equilateral) pentagonal shape. Other configurations of the apparatus may be configured for welding panels having other shapes.

Figure 4:
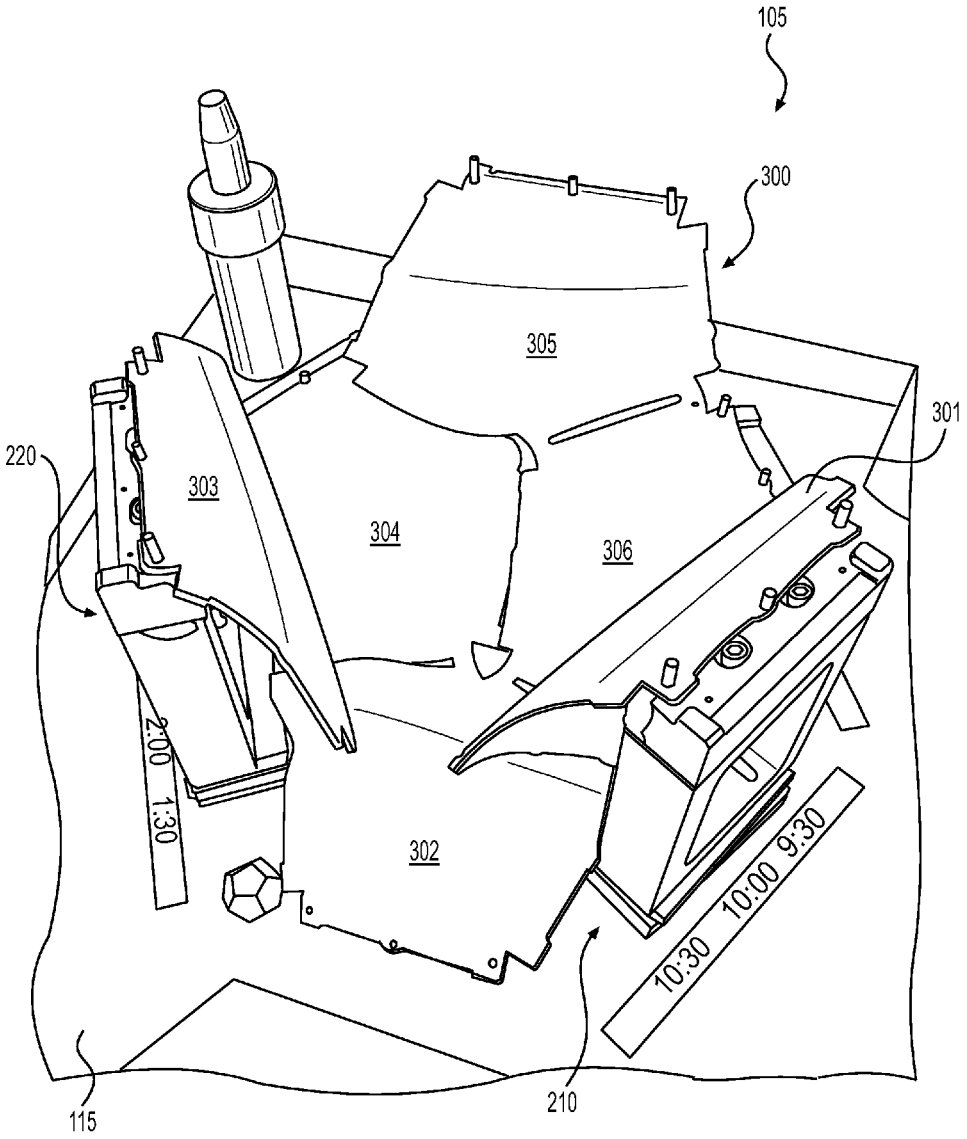
FIG. 4 is another schematic illustration of bottom panels of a sport ball casing being placed in the lower component shown in FIG. 2.

FIG. 4 is another view of panels of casing 300 being assembled in first component 105. FIG. 4 shows a view approximately 90 degrees rotated as compared to FIG. 3. As shown in FIG. 4, the panels of casing 300 may be preattached to one another. For example, all of the panels may be cut from the same sheet of casing material, leaving short connecting pieces between the panels to facilitate handling and assembly of the panels.

Figure 5:
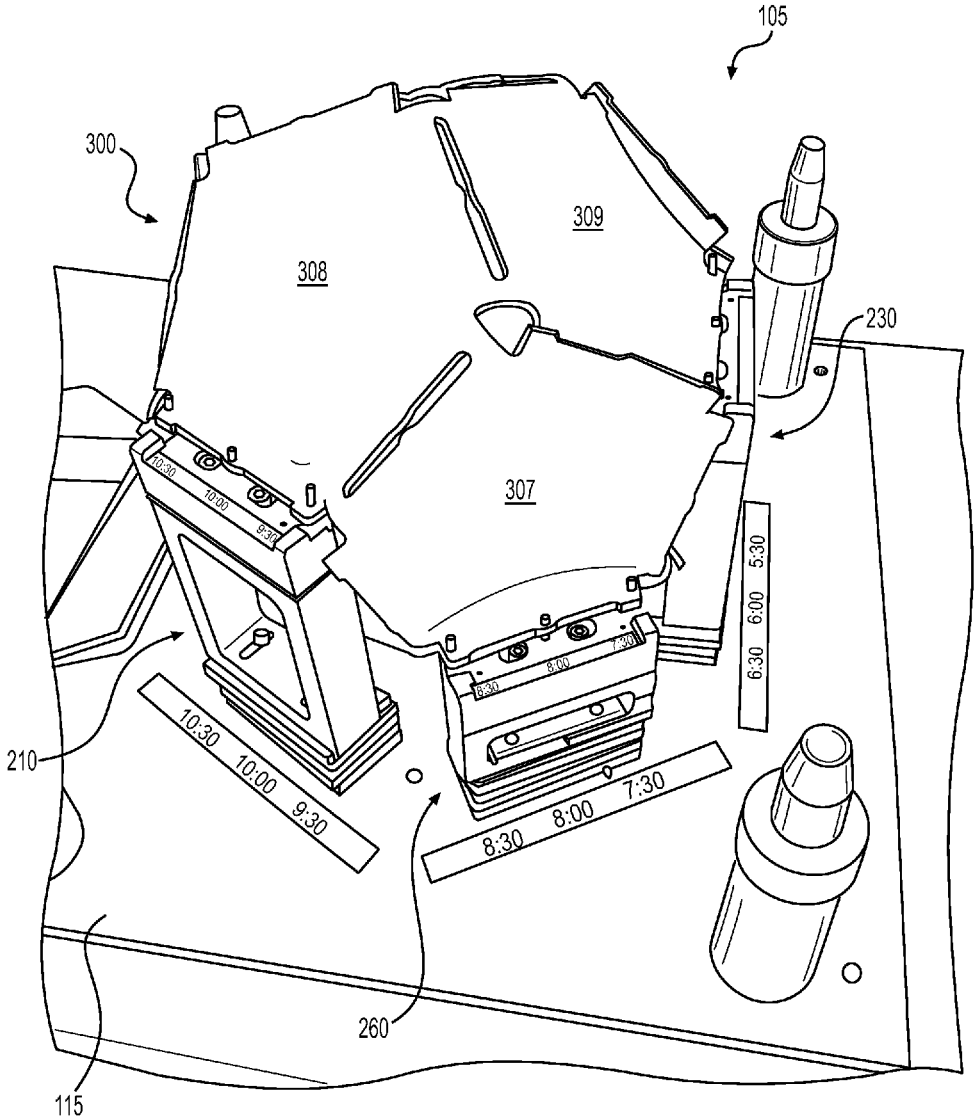
FIG. 5 is a schematic illustration of top panels of a sport ball casing being placed in the lower component shown in FIG. 2.

FIG. 5 shows additional panels of casing 300 being assembled. For example, FIG. 5 shows a seventh panel 307, an eighth panel 308, and a ninth panel 309. Three more panels may also be added that are not shown in this view, for a total of 12 pentagonal panels, which may be used to form a complete casing 300.

Figure 6:
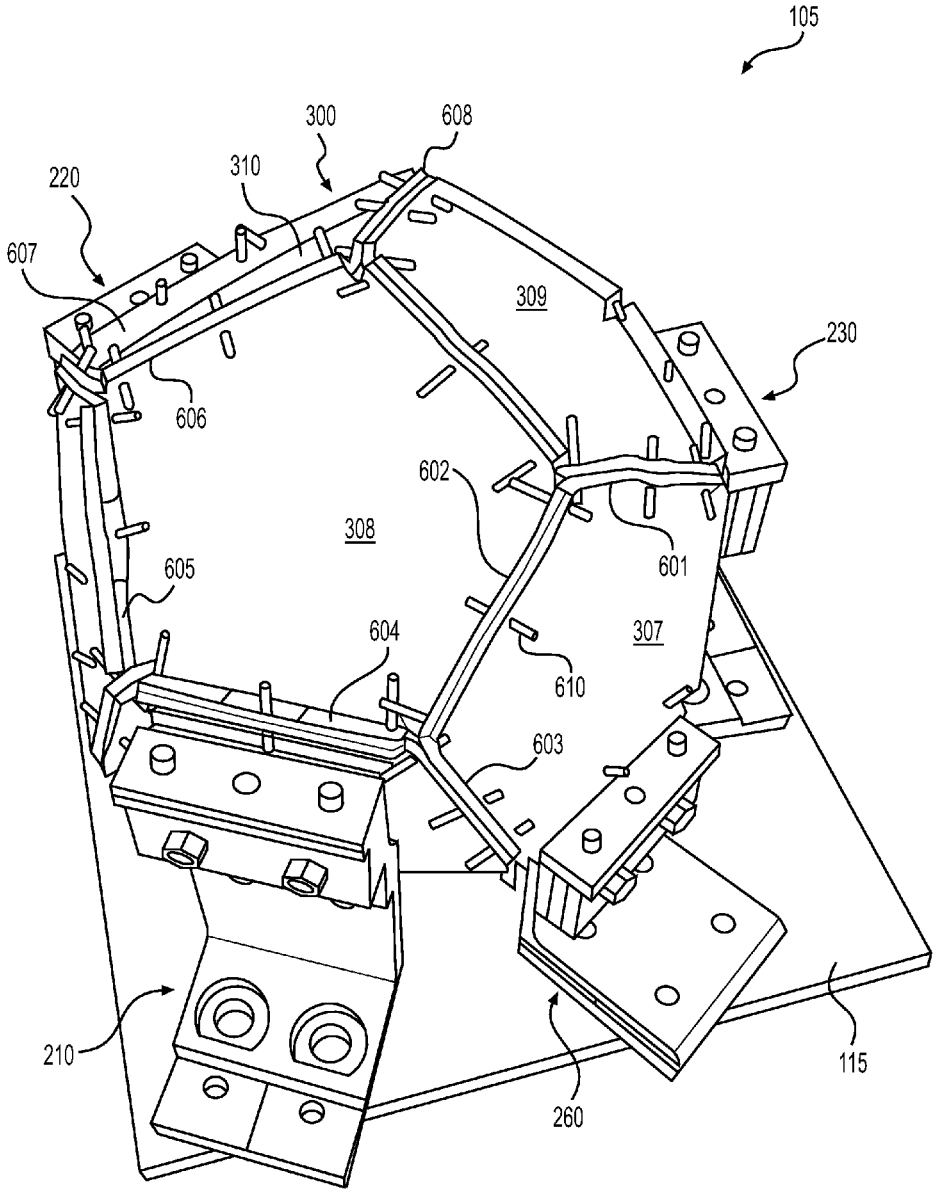
FIG. 6 is a schematic illustration of a preassembled casing of a sport ball wherein the panels are temporarily joined together with pins.

FIG. 6 illustrates a substantially fully pre-assembled ball casing 300 within first component 105. In FIG. 6, a tenth panel 310 is visible. In addition, the edges of the panels are mated together forming a plurality of flange portions configured to be welded. In order to facilitate alignment of adjacent panels, a plurality of pins 610 may be used, which may be inserted through registration apertures, as shown in FIG. 6. Any of the techniques for aligning adjacent panels using registration apertures disclosed in Raynak et al., U.S. Patent Application Publication No. 2010/0240479, published on Sep. 23, 2010, may be used for preassembly of casing 300.

Pins 610 may be used to temporarily join panels of casing 300 together and hold the panels together for welding of the seams. As joined with pins 610, the edges of the panels may form a plurality of flange portions. FIG. 6 shows several of these flange portions, including a first flange portion 601, a second flange portion 602, a third flange portion 603, a fourth flange portion 604, a fifth flange portion 605, a sixth flange portion 606, a seventh flange portion 607, and an eighth flange portion 608. Since casing 300 includes 12 pentagonal panels, the preassembled casing 300 includes 30 seams, and thus 30 flange portions.

Figure 7:
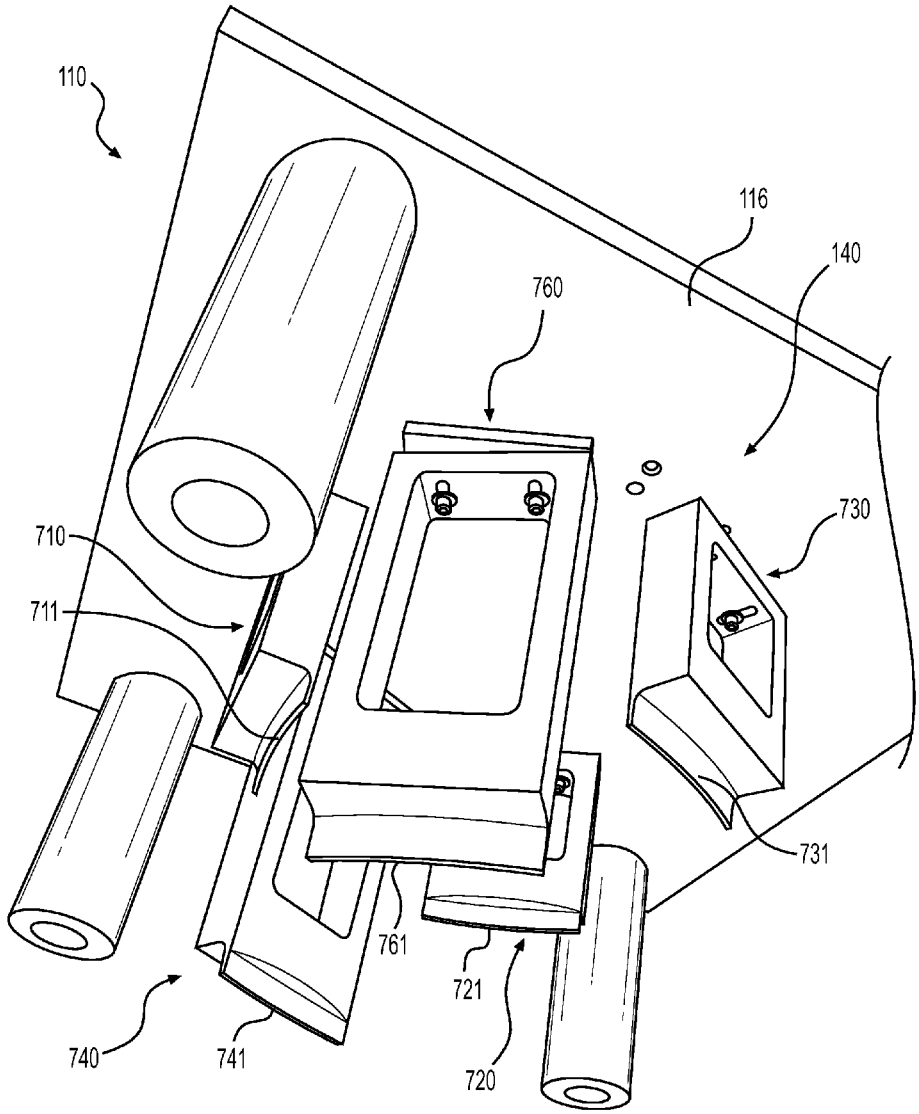
FIG. 7 is a schematic illustration of an upper component of the apparatus shown in FIG. 1.

FIG. 7 illustrates a perspective bottom view of second component 110. As shown in FIG. 7, welding dies 140 may include a plurality of welding dies that correspond with the support structures of the first component. For example, the welding dies may have varying heights that correspond with the heights of the support structures of the first component. That is, second component 110 may have shorter welding dies that correspond with the taller support structures of the first component. Similarly, second component 110 may have taller welding dies that correspond with the shorter support structures of the first component. The varying heights may enable different portions (flange portions) of the ball to rest between the welding dies and the support structures.

As shown in FIG. 7, second component 110 may include a plurality of shorter welding dies, such as a first welding die 710, a second welding die 720, and a third welding die 730. In addition, second component 110 may include a plurality of relatively taller welding dies, such as a fourth welding die 740, and a fifth welding die 760.

Each welding die may include a die edge configured to be aligned with the support edge of a support structure of the first component. For example, first welding die 710 may include a first die edge 711, second welding die 720 may include a second die edge 721, and third welding die 730 may include a third die edge 731. In addition, fourth welding die 740 may include a fourth die edge 741 and fifth welding die 760 may include a fifth die edge 761. As shown in FIG. 7, the die edges may be curved. The curvature of the die edges may correspond with the curvature of the ball.

The disclosed apparatus may be configured to receive, between the first component and the second component, a preassembled sport ball casing formed of a plurality of panels temporarily held together in an inside-out configuration with adjoining edges of the panels extending radially outward forming flange portions. In addition, the apparatus may be configured to weld the adjoining edges of the panels together by applying pressure to the flange portions and supplying welding energy to the flange portions to form welded seams.

Figure 8:
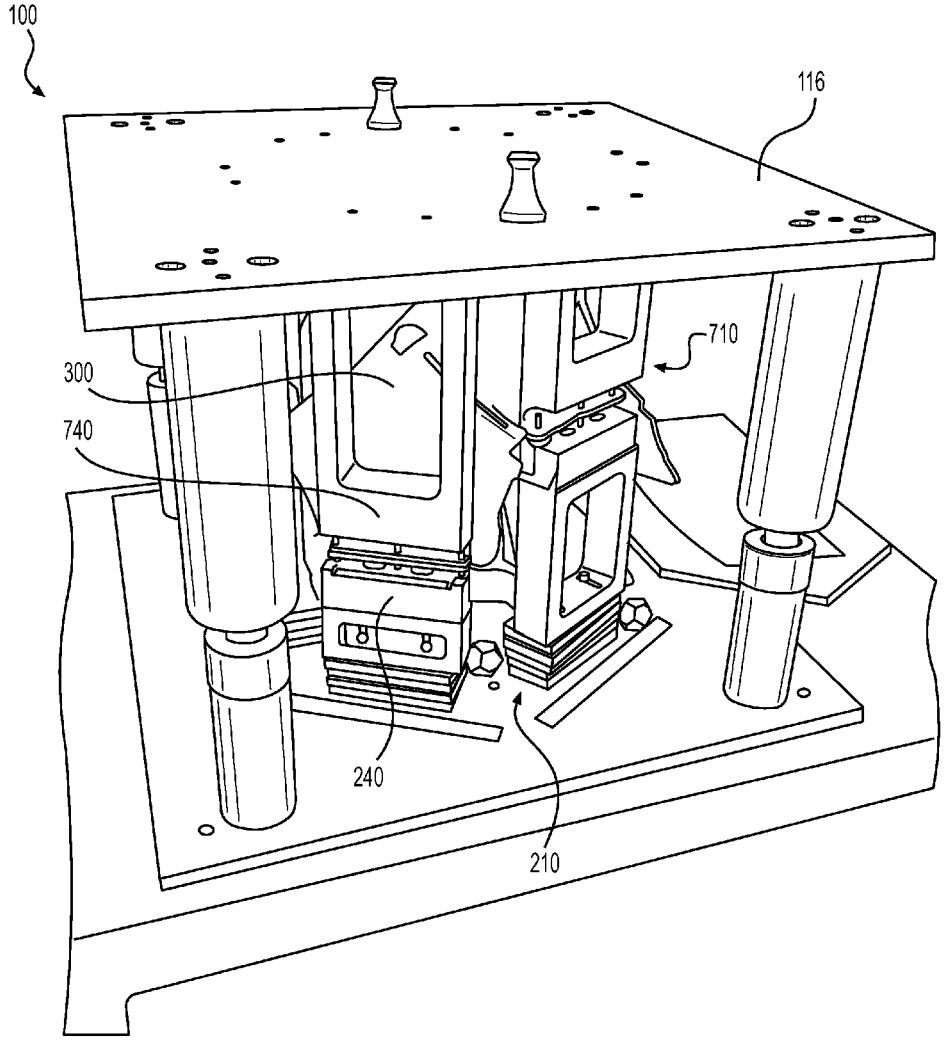
FIG. 8 is a schematic illustration of the upper component mounted on the lower component to weld the top panels to the bottom panels of the sport ball casing.

As shown in FIG. 8, once the panels of casing 300 are preassembled and the preassembled casing is inserted into first component 105, second component 110 may be assembled with first component 110. As further shown in FIG. 8, corresponding support structures and welding dies may compress flange portions of casing 300. For example, first welding die 710 may align with and may cooperate with first support structure 210. Similarly, fourth welding die 740 may align with and may cooperate with fourth support structure 240.

Figure 9:
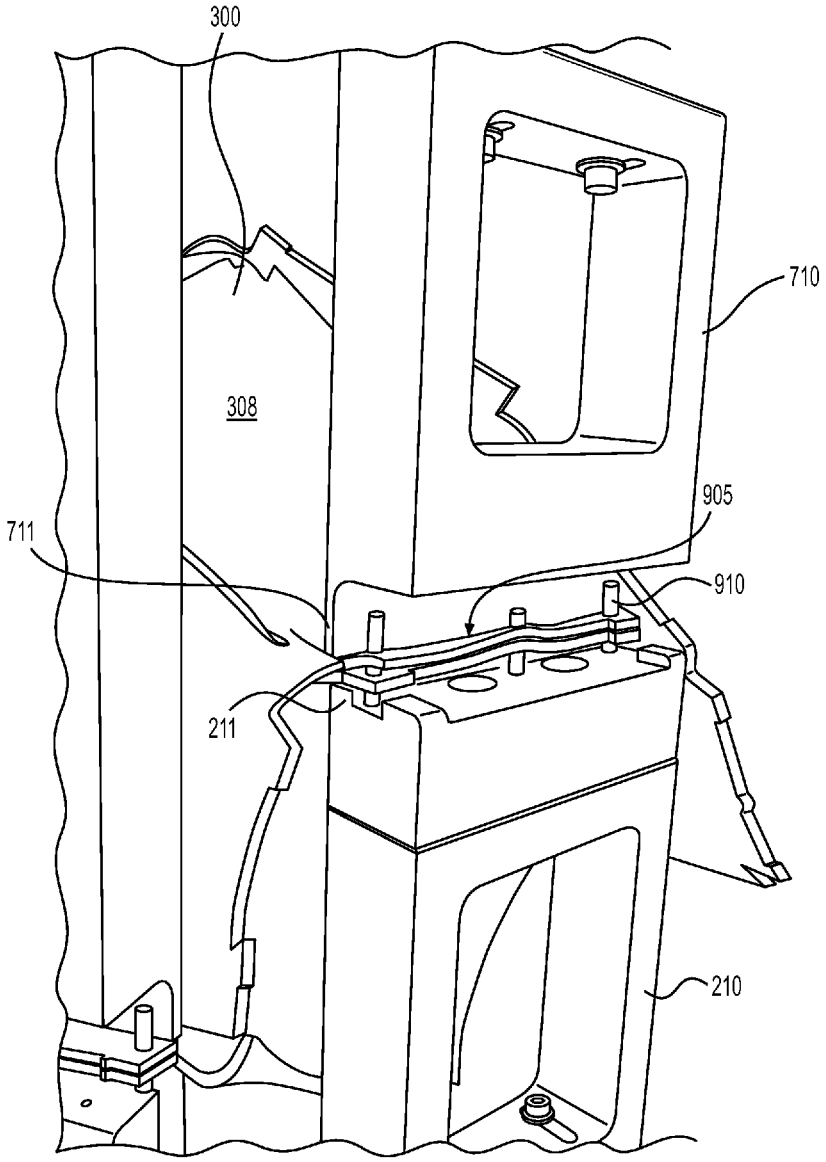
FIG. 9 is a schematic illustration of the welding of one seam between casing panels of a sport ball.

FIG. 9 is a larger view of a portion of FIG. 8. As shown in FIG. 8, pins 910 may hold the flange portions of the adjacent panels in alignment with one another. In addition, in some embodiments, pins 910 may insert into the support structures, to secure the flange areas to the support structures. As also shown in FIG. 8, a flange portion 905 formed by the temporary joinder of two panels may be compressed between first welding die 710 and first support structure 210. More specifically, flange portion 905 may be compressed by first die edge 711 and first support edge 211.

Once flange portion 905 is compressed as such, welding energy may be supplied to weld the panel edges together in flange portion 905. Supplying welding energy may heat flange portion 905, causing the panel edges in flange portion 905 to heat and melt or otherwise soften to a degree that facilitates welding, as depicted in FIG. 9, thereby forming a seam between panels.

In some embodiments, second component 110 may be configured to supply welding energy to edges of casing panels (that is, the flange portions) when the casing panels are compressed between the welding dies and the support structures. In some embodiments, second component 110 may be configured to supply radio frequency (RF) energy to heat the casing panels between the support structures and the welding dies. However, a variety of techniques may be utilized to weld the flange portions, including conduction heating, radiant heating, radio frequency (RF) heating, ultrasonic heating, and laser heating.

Once the seams have been welded, the second component 110 may be disassembled (removed) from first component 105, and the preassembled casing may be repositioned for subsequent welding of other seams of the casing. As illustrated in greater detail in FIGS. 10-19, multiple flange portions may be welded in the manner shown in FIG. 8 simultaneously. Therefore, multiple welded seams may be created at once. All panels of casing 300 are shown as transparent to illustrate additional detail. Hidden seams between panels are shown as dashed lines. In addition, hidden support structures as shown in phantom. As compared to FIG. 9, FIGS. 10-19 illustrate the flange portions at the seams between panels in a simpler, schematic appearance to provide clarity. For purposes of discussion of FIGS. 10-19, the junctions between casing panels, both welded and unwelded, will be referred to as seams.

In some embodiments, the apparatus may be configured to weld all seams of the casing with minimal repositioning of the casing. The apparatus may be configured to weld multiple seams simultaneously and, after repositioning the casing, weld all new seams without rewelding any seams that were welded in the previous welding step. The apparatus may also be configured such that the sequence of repositioning the casing in the apparatus includes a minimum number of steps and is repeatable with minimal learning. Further, the casing panels may have labeling that facilitates positioning and repositioning of the casing in between welding steps.

In some embodiments, operation of the apparatus may involve welding two or more seams. In some cases, this may include welding five seams of a sport ball casing simultaneously. For example, the welding may include welding six sets of seams, each of the six sets including five seams, thereby forming thirty welded seams. Forming thirty seams may join edges of 12 pentagonal panels to form an assembled sport ball casing.

Figure 10:
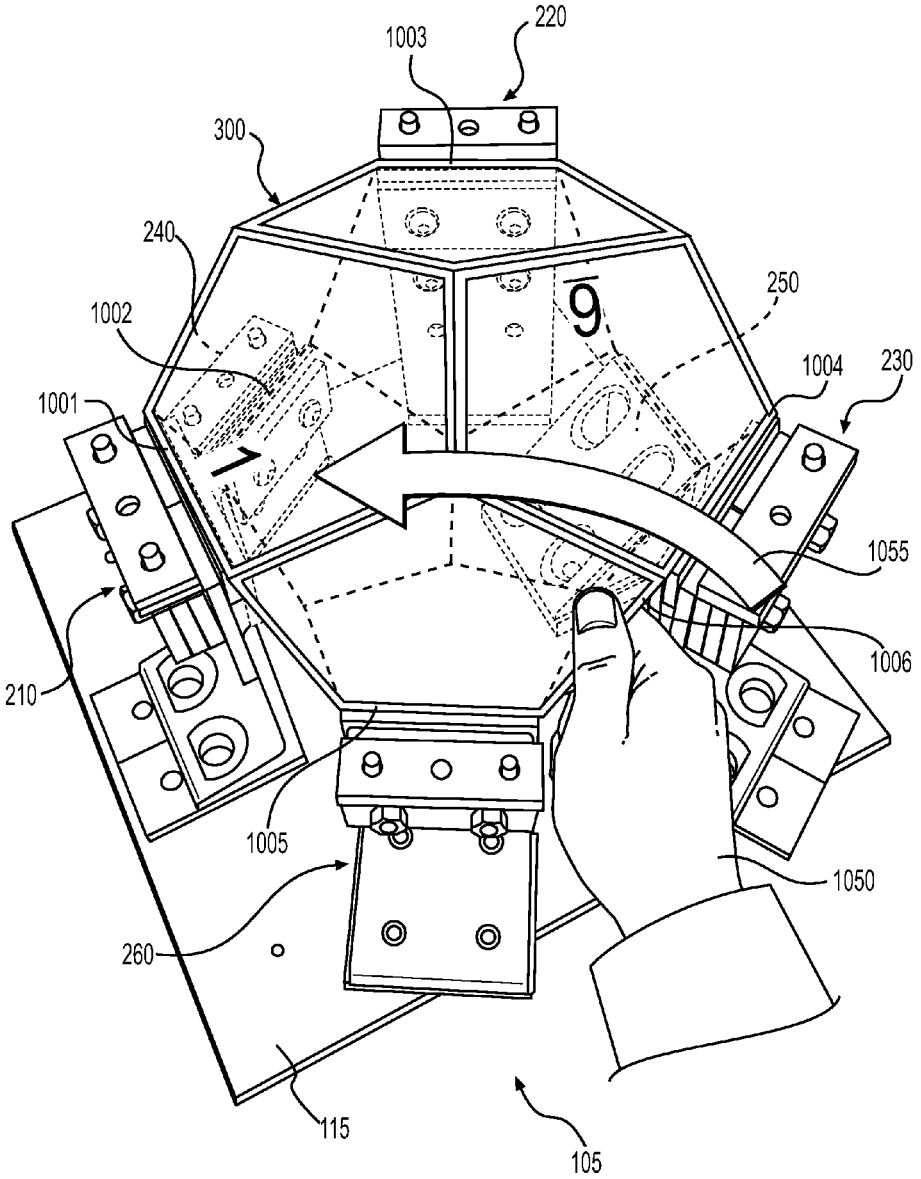
FIGS. 10-19 are schematic illustrations of a sequence of steps for rotating a pre-assembled casing in between welding steps.

In some embodiments, welding six sets of seams may include positioning the preassembled sport ball casing into the apparatus in a first position. FIG. 10 illustrates preassembled casing 300 positioned within first component 105 in the first position, as indicated by the large numeral "1" proximate first support structure 210. Such a numeral, or other similar indicia, may be provided on casing 300 to indicate to the user of the apparatus how casing 300 should be positioned to begin the welding process.

In this first position, six seams are disposed on support edges of support structures. However, only five seams will be welded. As shown in FIG. 10, a first seam 1001 may be supported by first support structure 210. Additionally, a second seam may be supported by fourth support structure 240. A third seam 1003 may be supported by second support structure 220. A fourth seam 1004 may be supported by third support structure 230. And a fifth seam 1005 may be supported by sixth support structure 260. It will be noted that fifth support structure 250 is shown, and supports a seam of casing 300. However, because the second component does not include a welding die that corresponds with fifth support structure 250, this seam will not be welded while in this position. Once preassembled casing 300 is positioned in the first position, the second component may be assembled with first component 105, and welding energy may be simultaneously applied to the first set of five seams, including first seam 1001, second seam 1002, third seam 1003, fourth seam 1004, and fifth seam 1005.

After welding of the first set of five seams, the second component may be removed, and the next step may include repositioning preassembled sport ball casing 300 into the apparatus into a second position. In order to reposition casing 300 into the second position, the operator may grasp casing 300 by a sixth seam 1006, with the hand positioned as indicated by 1050. Gripping casing 300 in this way is facilitated by the outwardly extending flange portion at the seam (which flange portions, again, are not shown in FIGS. 10-19 for clarity). The operator may then lift casing 300 by sixth seam 1006, and rotate casing 300 generally in the direction of arrow 1055, moving sixth seam 1006 toward first support structure 210.

Figure 11:
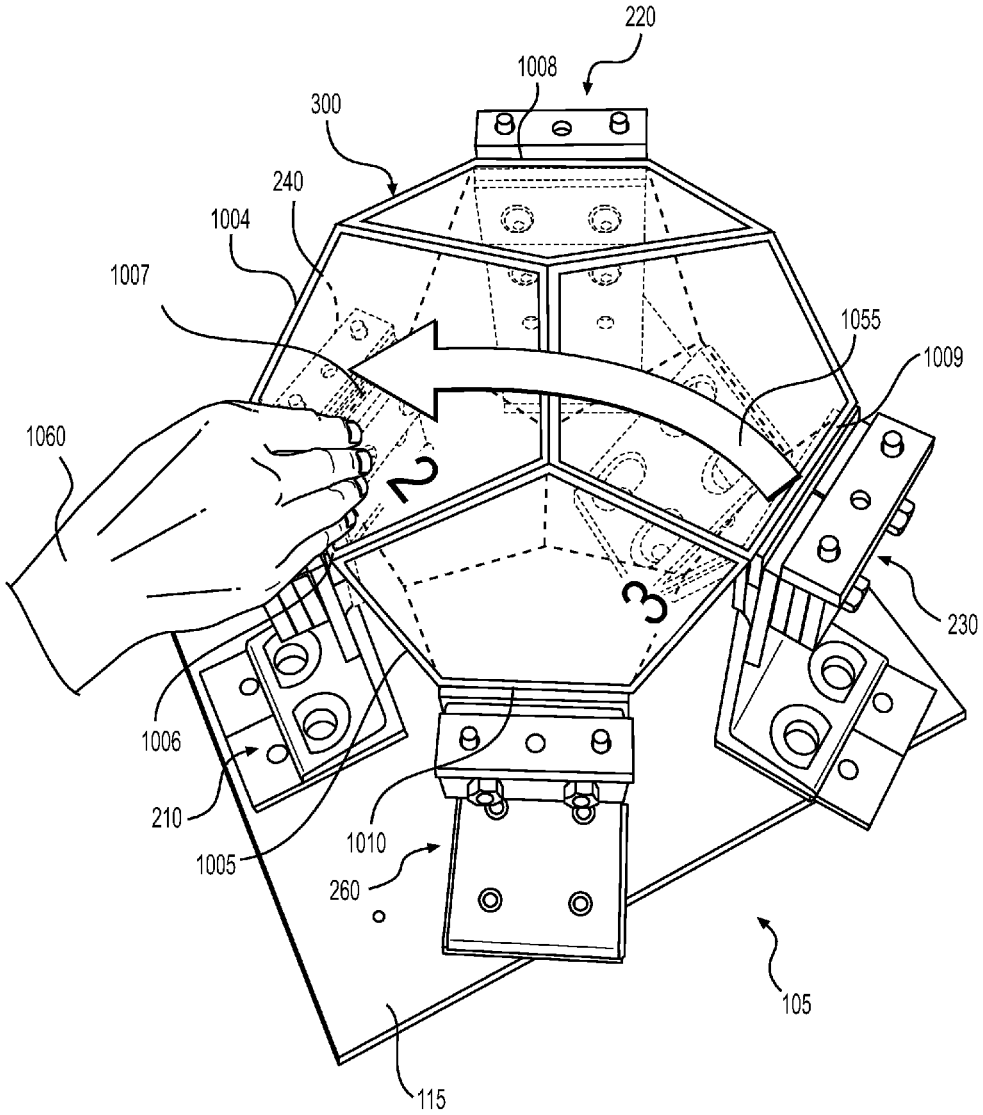

FIG. 11 illustrates the first component and casing 300 after casing 300 has been rotated in the direction of arrow 1055 to the second position, thus positioning sixth seam 1006 on first support structure 210. To complete this movement to the second position, the operator not only rotates the ball to reposition sixth seam 1006 onto first support structure 210, but also, the operator rotates their hand counter-clockwise, completing the movement with their palm down, as indicate by the hand position 1060 in FIG. 11.

As indicated in FIG. 11, five new seams are now positioned atop support structures and are ready for welding. For example, a second set of five seams may include sixth seam 1006, which is supported by first support structure 210 in the second position. In addition, the second set of five seams may include a seventh seam 1007, an eighth seam 1008, a ninth seam 1009, and a tenth seam 1010. As shown in FIG. 11, seventh seam 1007 may be supported by fourth support structure 240, eighth seam 1008 may be supported by second support structure, ninth seam 1009 may be supported by third support structure 230, and tenth seam 1010 may be supported by sixth support structure 260.

As shown in FIG. 11, the positioning of casing 300 in the second position is indicated by the large numeral "2" proximate first support structure 210. This "2" or other such indicia may be provided to indicate to the operator how casing 300 should be positioned for the second welding step. Once the second position is achieved, the second component may be assembled, and the step of simultaneously welding the second set of five seams may be executed.

Figure 12:
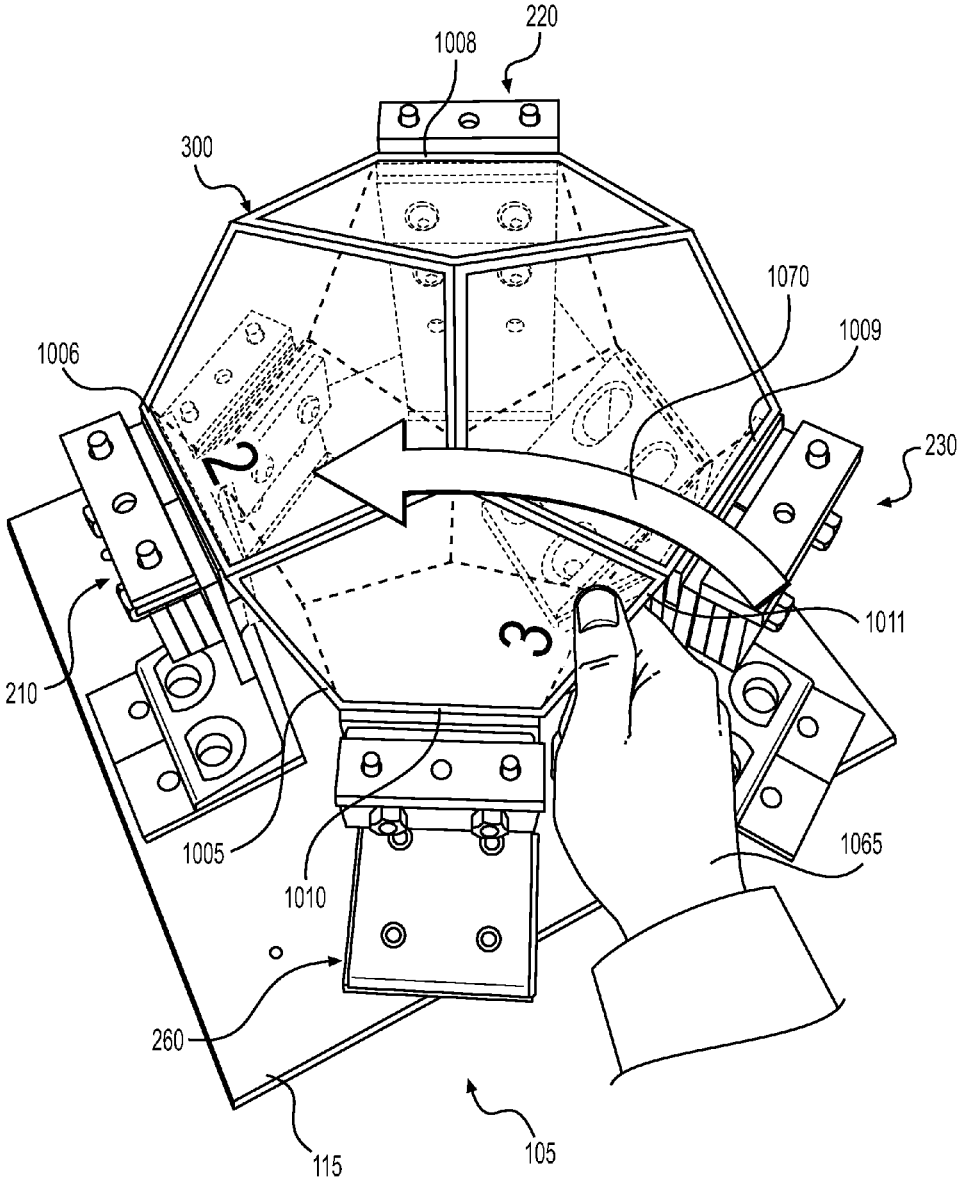

As shown in FIG. 12, the operator may then initiate the repositioning from the second position (shown in FIG. 12), to the third position. The operator again grasps the seam at the lower right, here referred to as eleventh seam 1011, as indicated by hand position 1065. The operator may then execute the repositioning of the preassembled sport ball casing into a third position, by rotating casing 300 as generally indicated by an arrow 1070.

Figure 13:
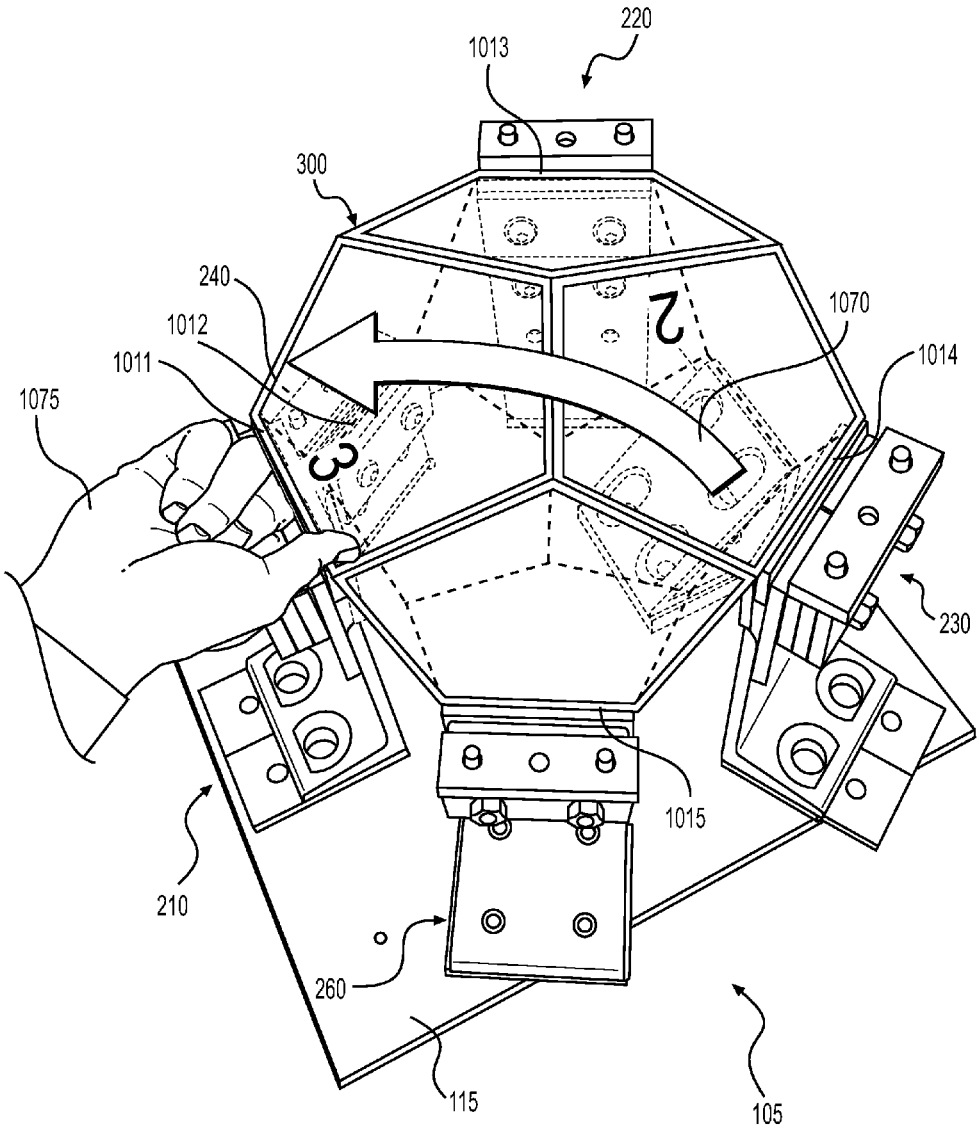
Figure 14:
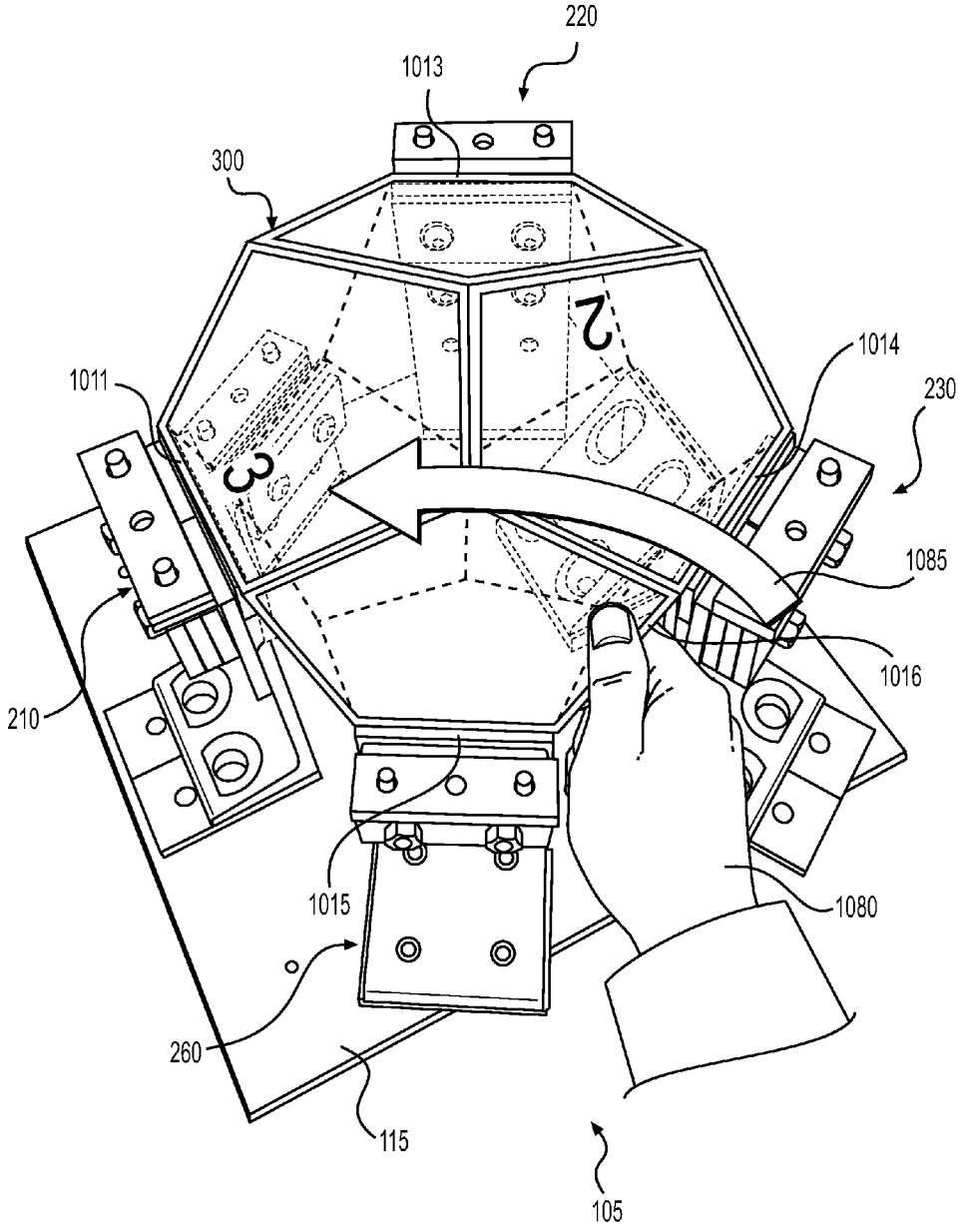

FIG. 13 shows casing 300 having been repositioned to the third position, as indicated by the proximity of numeral "3" proximate to first support structure 210. Accordingly, in the third position, eleventh seam 1011 may be supported by first support structure 210, as shown in FIG. 13. A difference between the repositioning from the first position to the second position and the repositioning from the second position to the third position may be found in the orientation of the hand when placing the eleventh seam onto first support structure 210. While the first repositioning involved a palm down (i.e., counter-clockwise) rotation, the second repositioning (to the third position) may involve a palm up (i.e., clockwise) rotation, as indicated by hand position 1075 in FIG. 13.

In the third position, the third set of five seams may be located atop support structures ready for welding. In particular, eleventh seam 1011 may be supported by first support structure 210, twelfth seam 1012 may be supported by fourth support structure 240, thirteenth seam 1013 may be supported by second support structure 220, fourteenth seam 1014 may be supported by third support structure 230, and fifteenth seam 1015 may be supported by sixth support structure 260. Once casing 300 is positioned in this third position, the operator may carry out the simultaneous welding of this third set of five seams, as described above with respect to the previous welding steps.

The step of repositioning the preassembled sport ball casing into the fourth position may involve substantially the same repositioning movement as the first repositioning step. That is, the operator may grab a sixteenth seam 1016 in the lower right of FIG. 14, rotate casing 300 in the direction of an arrow 1085, and position sixteenth seam 1016 onto first support structure 210 with the palm down as indicated by hand position 1090 in FIG. 15.

Figure 15:
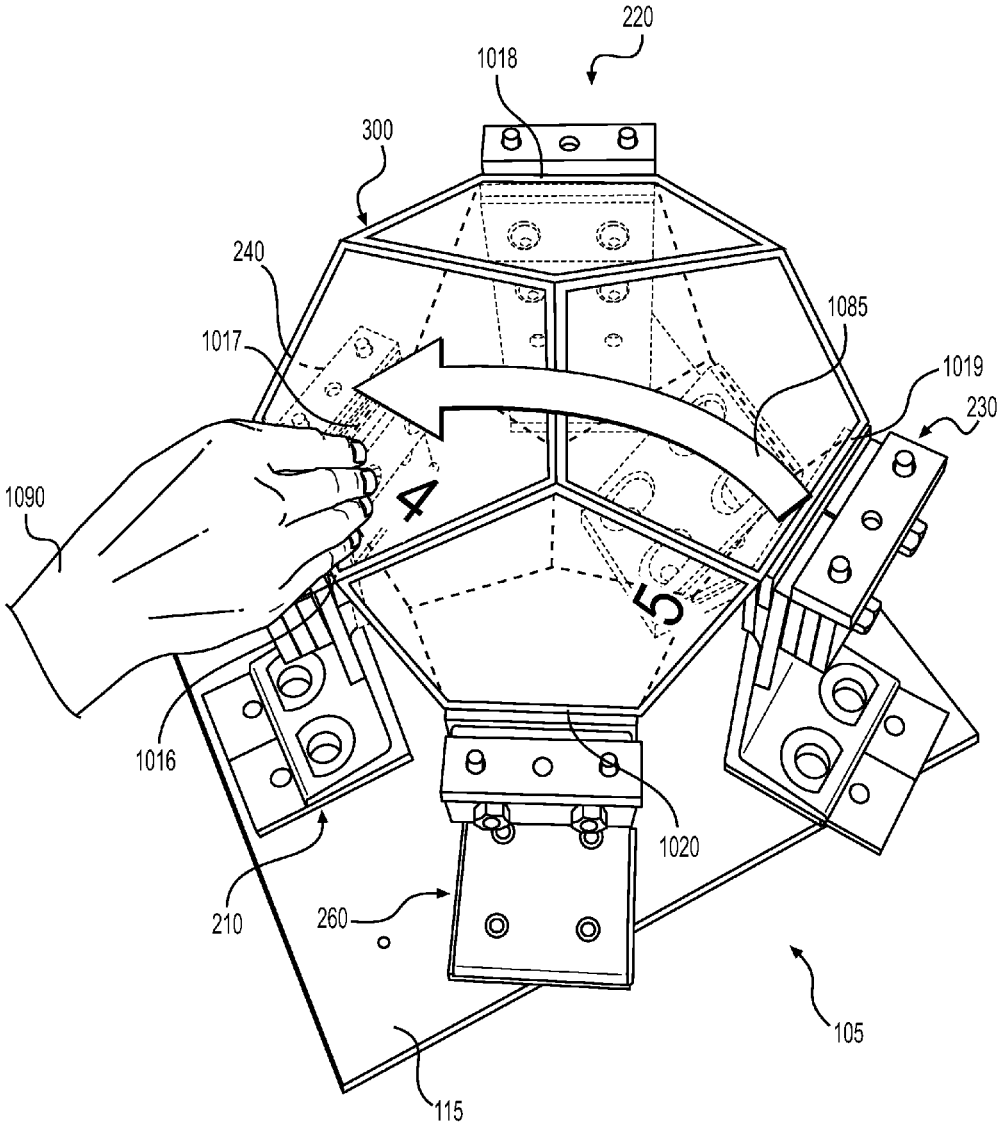

As shown in FIG. 15, with casing 300 in the fourth position (as indicated by the proximity of numeral "4" to first support structure 210), a fourth set of five seams may be positioned for welding. In particular, sixteenth seam 1016 may be supported by first support structure 210, a seventeenth seam 1017 may be supported by fourth support structure 240, an eighteenth seam 1018 may be supported by second support structure 220, a nineteenth seam 1019 may be supported by third support structure 230, and a twentieth seam 1020 may be supported by sixth support structure 260. With casing 300 in the fourth position, the operator may proceed with simultaneous welding of the fourth set of five seams using the apparatus.

Figure 16:
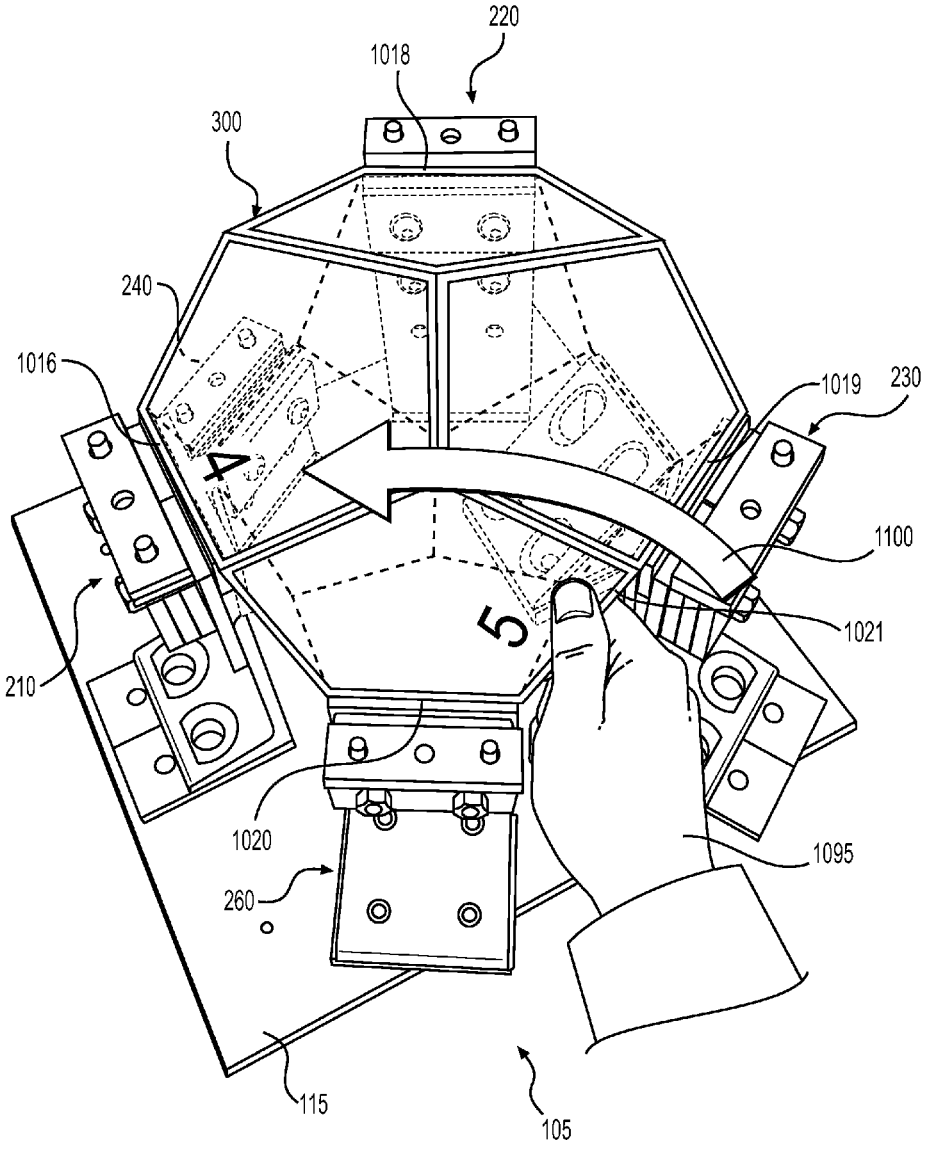
Figure 17:
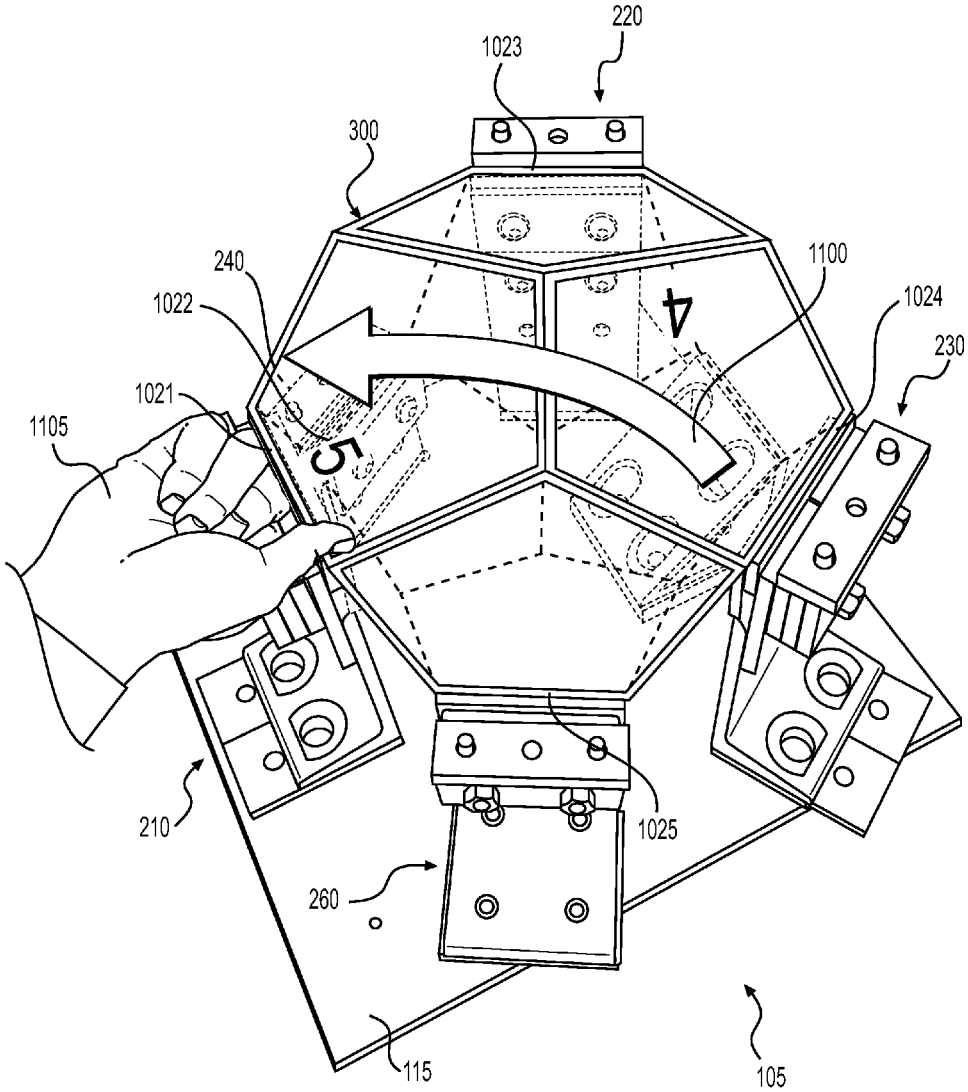

As shown in FIG. 16, the operator may commence the repositioning of the preassembled sport ball casing into a fifth position by grasping a twenty-first seam 1021 at the lower right of FIG. 16, as indicated by hand position 1095. The operator may then rotate casing 300 generally in the direction of arrow 1100 to the fifth position shown in FIG. 17. As illustrated in FIG. 17, the fifth position may be achieved by a clockwise rotation of the ball by which the repositioning may be completed with a palm up orientation, as indicated by hand position 1105 in FIG. 17. FIG. 17 further shows numeral "5" proximate to first support structure 210, indicating that the fifth position has been achieved. Accordingly, the operator may proceed with the simultaneous welding of a fifth set of five seams. The fifth set of five seams includes twenty-first seam 1021, a twenty-second seam 1022, a twenty-third seam 1023, a twenty-fourth seam 1024, and a twenty-fifth seam 1025. In the fifth position, these five seams are situated on the support members in the same manner as the first four sets of five seams described above.

Figure 18:
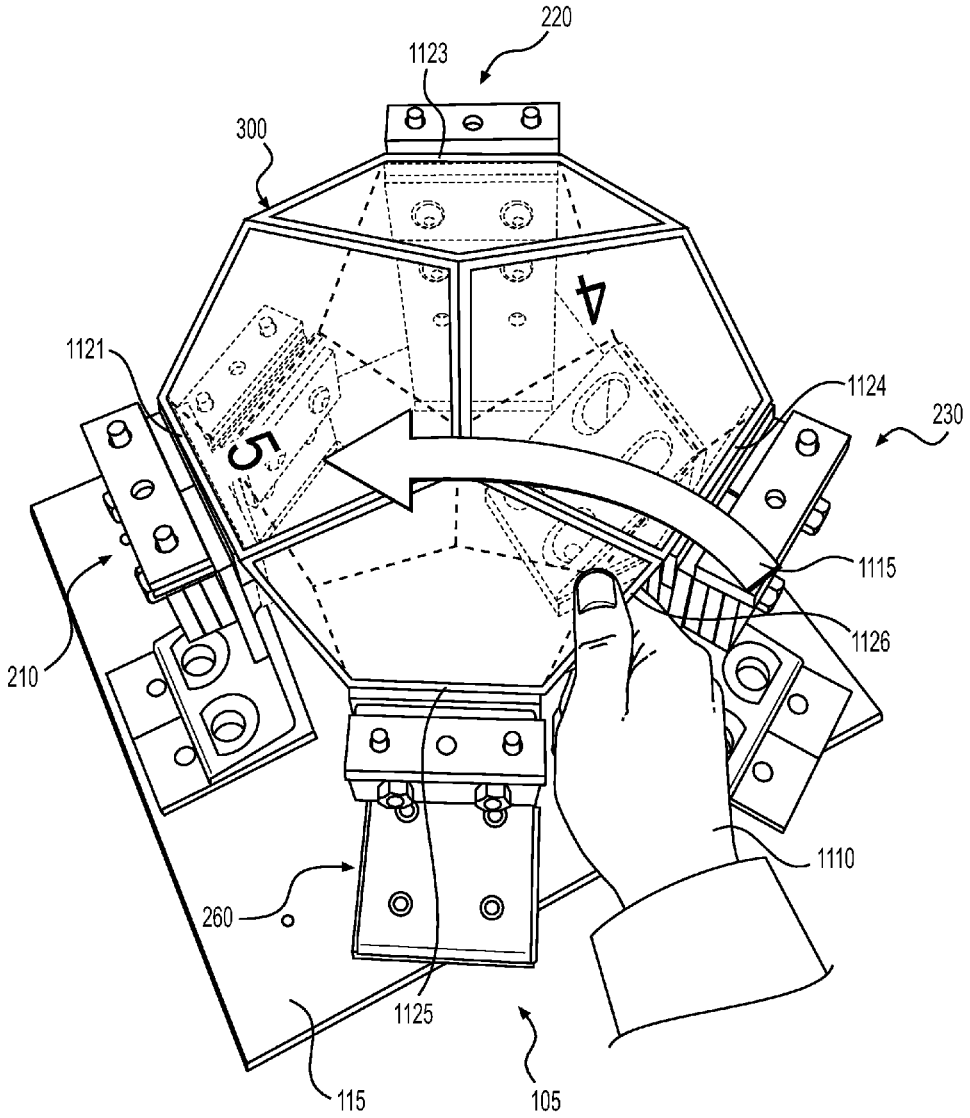
Figure 19:
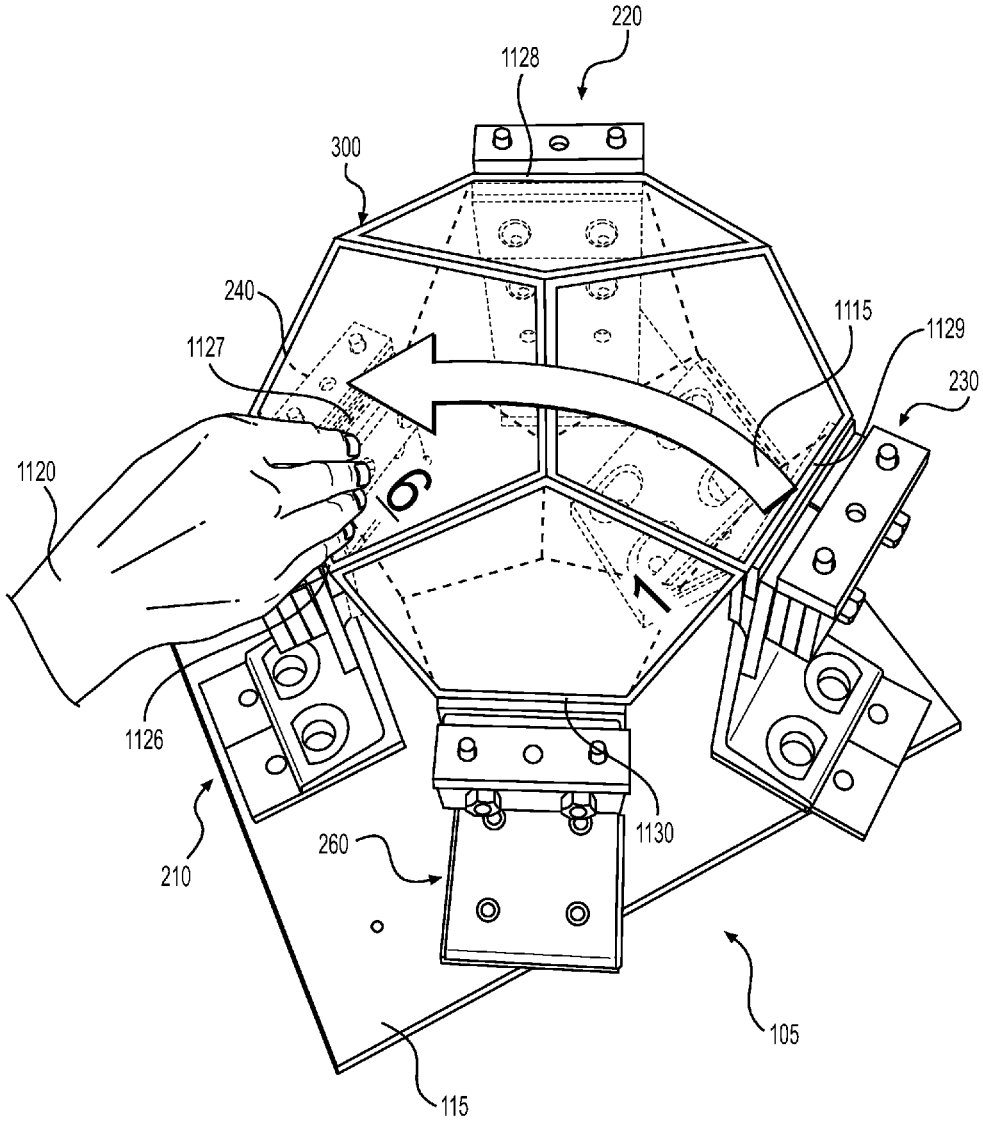

FIG. 18 illustrates the operator beginning the repositioning of the preassembled sport ball casing into a sixth position. As shown in FIG. 18, the operator may grasp a twenty-sixth seam 1126 with their hand at position 1110 and rotate casing 300 in a general direction 1115. As shown in FIG. 19, the operator may complete the repositioning of casing 300 to the sixth position with a palm down hand orientation 1120. In the sixth position, numeral "6" is positioned proximate to first support structure 210, as shown in FIG. 19. In the sixth position, a sixth set of five seams may be positioned for welding, including twenty-sixth seam 1126, twenty-seventh seam 1127, twenty-eighth seam 1128, twenty-ninth seam 1129, and thirtieth seam 1130. With casing 300 in the sixth positioning, the operator may proceed with the simultaneous welding of the sixth set of five seams.

It will be noted that the repositioning procedure may be facilitated by the fact that the sequence involves repeated execution of the same two movements in alternating fashion. Accordingly, repositioning the preassembled sport ball casing into the second position, repositioning the preassembled sport ball casing into the fourth position, and repositioning the preassembled sport ball casing into the sixth position may each involve the same first rotational movement of the sport ball casing. Further, repositioning the preassembled sport ball casing into the third position and repositioning the preassembled sport ball casing into the fifth position may each involve the same second rotational movement of the sport ball casing.

Figure 20:
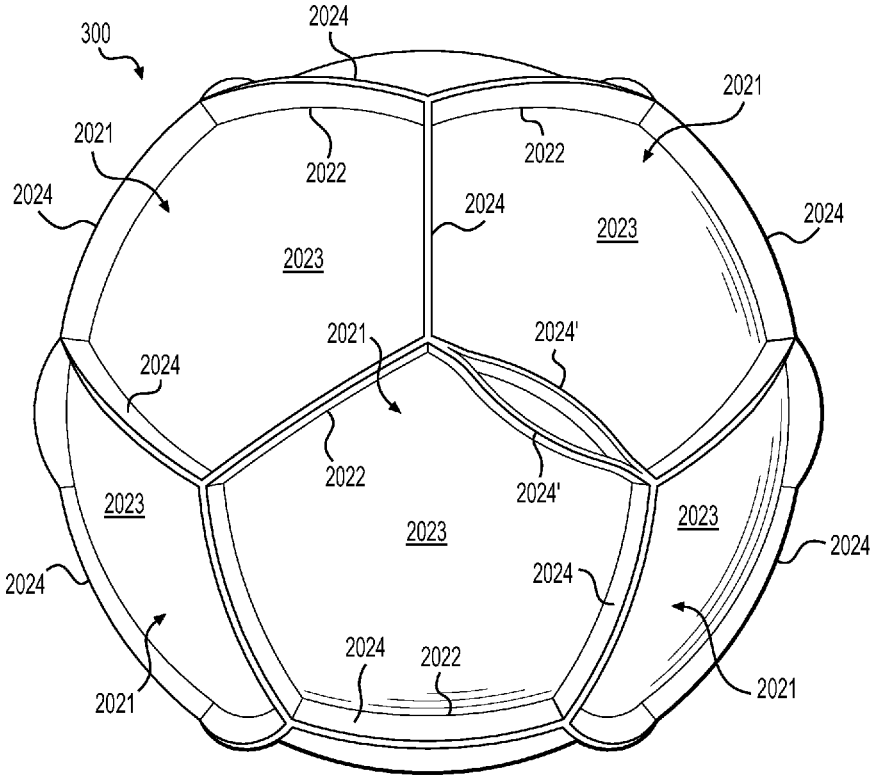
FIG. 20 is a schematic illustration of an assembled sport ball casing inside out as welded.

The welding process described above may produce a sport ball casing 300 having an inside out configuration. As shown in FIG. 20, casing 300 may include a plurality of panels 2021, including outward facing panel surfaces 2023. The welding techniques may have produced a plurality of welds 2022 forming a plurality of flange portions 2024 at the seams. A variety of trimming processes may be utilized to remove the excess portions of flange areas 2024. In some embodiments, the trimming of flange portions 2024 may be performed with a slice through technique using a steel rule, a chopping technique against an anvil, or a chopping/slicing technique involving slicing through to a slot. In other embodiments, the trimming processes may include the use of a grinding wheel or an etching process.

Although seams are generally formed between each of flange portions 2024, at least two flange portions may remain unbonded to each other at this stage of the manufacturing process. As shown in FIG. 20, unbonded flange portions are identified with reference numeral 2024'. One purpose of leaving at least two flange areas unbonded to each other is that casing 300 may be turned right side out through an opening formed between the unbonded flanges 2024'. More particularly, the unbonded flange areas 2024' may be separated to form an opening, as depicted in FIG. 20, and casing 300 may be reversed or turned right-side-out through that opening to impart the configuration depicted in FIG. 21.

Whereas the trimmed flange portions 2024 protrude outward in FIG. 20, reversing or turning casing 300 right-side-out through the opening between unbonded flange portions 2024' places all of flange portions 2024 within casing 300. Accordingly, the trimmed flange portions 2024 protrude inward, rather than outward, once casing 300 is reversed or turned right-side-out. The exterior of casing 300 may have a generally smooth configuration when portions of casing 300 corresponding with flange portions 2024 protrude inward.

The unbonded seam may be provided in one of several ways during the welding process described above. In some embodiments, an energy blocking material may be placed between one of the welding dies and the casing for one or more of the welding steps. For example, an RF blocking sheet may be inserted between the welding die and the flange portion of the casing as the second component is assembled with the first component in preparation for a welding step. In some embodiments, one of the welds may be pulled apart. This may be further facilitated if done when the weld is fresh and still warm.

At this stage of the manufacturing process, casing 300 is substantially formed and the surfaces of casing 300 are correctly oriented. The opening in casing 300 formed between unbonded flange areas 2024 may now be utilized to insert an intermediate layer and a bladder.

Exemplary intermediate layers may be formed to include one or more of a compressible foam layer that provides a softened feel to the sport ball, a rubber layer that imparts energy return, and a restriction layer to restrict expansion of the bladder. The overall structure of the intermediate layer may vary significantly. As an example, the restriction layer may be formed from (a) a thread, yarn, or filament that is repeatedly wound around the bladder in various directions to form a mesh that covers substantially all of the bladder, (b)

a plurality of generally flat or planar textile elements stitched together to form a structure that extends around the bladder, (c) a plurality of generally flat or planar textile strips that are impregnated with latex and placed in an overlapping configuration around the bladder, or (d) a substantially seamless spherically-shaped textile. In some configurations of ball 2010, an intermediate layer or portions of an intermediate layer may also be bonded, joined, or otherwise incorporated into the casing, for example, as a backing material, or the intermediate layer may be absent from ball 2010. Accordingly, the structure of the intermediate layer may vary significantly to include a variety of configurations and materials.

The bladder may have an inflatable configuration and may be located within the intermediate layer to provide an inner portion of ball 2010. When inflated, the bladder exhibits a rounded or generally spherical shape. In order to facilitate inflation, the bladder may include a valved opening that extends through the intermediate layer and the casing, thereby being accessible from an exterior of ball 2010, or the bladder may have a valveless structure that is semi-permanently inflated. The bladder may be formed from a rubber or carbon latex material that substantially prevents air or other fluids within the bladder from diffusing to the exterior of ball 2010. In addition to rubber and carbon latex, a variety of other elastomeric or otherwise stretchable materials may be utilized for the bladder. The bladder may also have a structure formed from a plurality of joined panels, as disclosed in U.S. patent application Ser. No. 12/147,943, filed in the U.S. Patent and Trademark Office on 27 Jun. 2008, which is incorporated herein by reference in its entirety.

Figure 21:
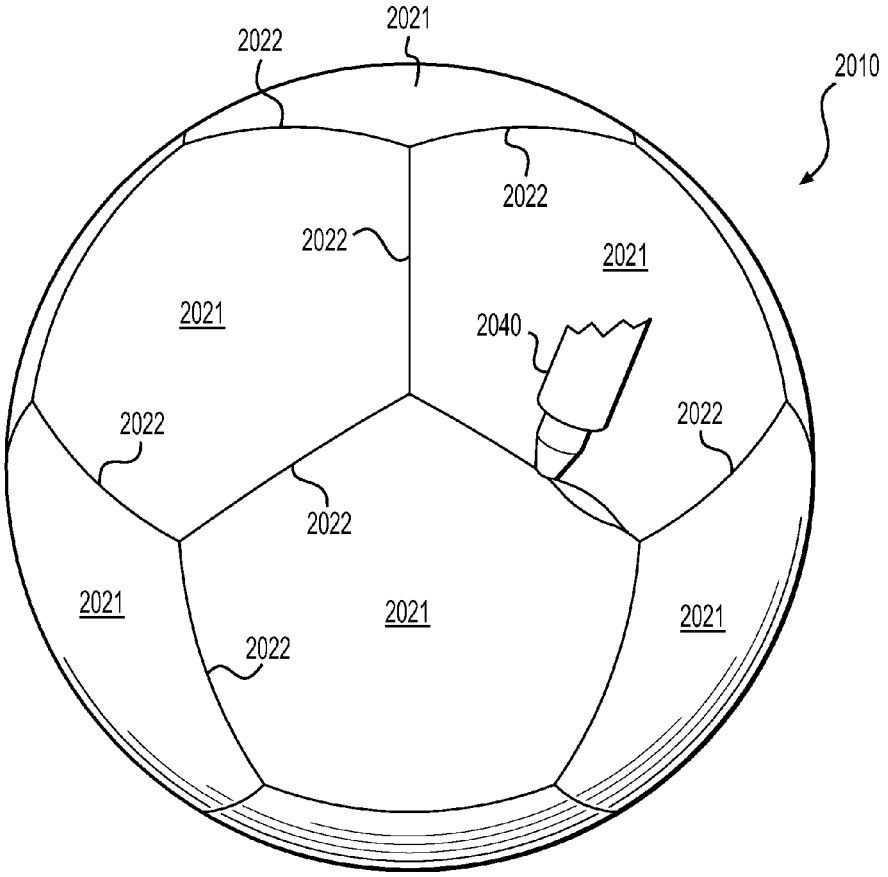
FIG. 21 is a schematic illustration of a sport ball casing having a final seam sealed after being turned right side out.

Once the intermediate layer and the bladder are properly positioned within the casing, the opening in the casing formed between unbonded flange areas may be sealed, as depicted in FIG. 21. For example, a sealing die 2040 (which is shown schematically) may form a weld between the unbonded flange areas to form a final seam that effectively closes the casing, thereby substantially completing the manufacturing process of ball 2010. As an alternative to welding, stitching or adhesives may be utilized to close the final seam of the casing.

While various embodiments of the invention have been described, the description is intended to be exemplary, rather than limiting and it will be apparent to those of ordinary skill in the art that many more embodiments and implementations are possible that are within the scope of the invention. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the invention is not to be restricted except in light of the attached claims and their equivalents. Also, various modifications and changes may be made within the scope of the attached claims.

What is claimed is:

1. An apparatus for manufacturing a sport ball, the apparatus comprising:

a first component having a first baseplate and a plurality of support structures extending from the first baseplate;

wherein a first one of the plurality of support structures has a first height;

wherein a second one of the plurality of support structures has a second height that is less than the first height; and a second component having a second baseplate and a plurality of welding dies extending from the second baseplate;

wherein a first one of the plurality of welding dies has a third height;

wherein a second one of the plurality of welding dies has a fourth height that is greater than the third height;

wherein the first component is disposed adjacent to the second component such that the first one of the plurality of support structures aligns with the first one of the plurality of welding dies and the second one of the plurality of support structures aligns with the second one of the plurality of welding dies; and wherein the second component is configured to supply welding energy to the sport ball when the sport ball is compressed between the plurality of welding dies and the plurality of support structures.

2. The apparatus of claim 1, wherein the apparatus is configured to weld multiple seams of the sport ball simultaneously.

3. The apparatus of claim 2, wherein the apparatus is configured to weld five seams of the sport ball simultaneously.

4. The apparatus of claim 1, wherein the second component is configured to supply radio frequency energy to heat the sport ball between the plurality of support structures and the plurality of welding dies.

5. The apparatus of claim 1, wherein at least one of the plurality of support structures includes a support edge and at least one of the plurality of welding dies includes a die edge configured to align with the support edge.

6. A sport ball manufacturing system comprising:

an apparatus including:

a first component having a first baseplate and a plurality of support structures extending from the first baseplate;

wherein a first one of the plurality of support structures has a first height;

wherein a second one of the plurality of support structures has a second height that is less than the first height;

a second component having a second baseplate and a plurality of welding dies extending from the second baseplate;

wherein a first one of the plurality of welding dies has a third height;

wherein a second one of the plurality of welding dies has a fourth height that is greater than the third height;

wherein the first component and the second component are translatable along an axis with respect to one another such that the first one of the plurality of support structures aligns with the first one of the plurality of welding dies and the second one of the plurality of support structures aligns with the second one of the plurality of welding dies; and a preassembled sport ball casing disposed between and in contact with the first component and the second component;

wherein the preassembled sport ball casing is formed from a plurality of panels temporarily held together by the first component and the second component in an inside-out configuration;

wherein a first one of the plurality of panels has a first edge;

wherein a second one of the plurality of panels has a second edge abutting the first edge to form a first flange portion;

wherein the first flange portion is disposed between the first one of the plurality of support structures and the first one of the plurality of welding dies;

and wherein the first one of the plurality of welding dies is configured to weld the first edge and the second edge together by applying pressure to the first flange portion against the first one of the plurality of support structures and supplying welding energy to the first flange portion to form a first welded seam.

7. The sport ball manufacturing system of claim 6, wherein a third one of the plurality of panels has a third edge and a fourth one of the plurality of panels has a fourth edge abutting the third edge to form a second flange portion;

wherein the third edge and the fourth edge are disposed between the second one of the plurality of support structures and the second one of the plurality of welding dies;

wherein the second one of the welding dies is configured to weld the third edge and the fourth edge together by applying pressure to the second flange portion against the second one of the plurality of support structures and supplying welding energy to the second flange portion to form a second welded seam such that the first welded seam and the second welded seam are formed simultaneously.

8. The sport ball manufacturing system of claim 7, wherein the preassembled sport ball casing has thirty flange portions and wherein the apparatus is configured to form five welded seams simultaneously.

9. The sport ball manufacturing system of claim 8, wherein the preassembled sport ball casing includes twelve pentagonal panels.

10. The sport ball manufacturing system of claim 6, wherein the first one of the welding dies is configured to supply radio frequency welding energy to the first flange portion.

* * * * *